US008266998B1

(12) United States Patent
Davis

(10) Patent No.: US 8,266,998 B1
(45) **Date of Patent: *Sep. 18, 2012**

(54) FIREARM MODIFICATION KIT

(76) Inventor: Doug Davis, Grand Bay, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/398,423

(22) Filed: Feb. 16, 2012

Related U.S. Application Data

(63) Continuation-in-part of application No. 12/292,770, filed on Nov. 26, 2008, now Pat. No. 8,117,954.

(51) Int. Cl.
*B64D 1/04* (2006.01)
*F41F 5/00* (2006.01)

(52) U.S. Cl. ..... 89/1.4; 42/71.01

(58) Field of Classification Search ..... 89/1.4; 42/71.01, 72
See application file for complete search history.

(56) References Cited

U.S. PATENT DOCUMENTS 2,454,885 A 11/1948 Robinson
3,225,653 A 12/1965 Packard
6,019,024 A 2/2000 Robinson
6,782,791 B2 8/2004 Moore
7,219,463 B2 5/2007 Wossner
7,231,861 B1 6/2007 Gauny
7,261,029 B1 8/2007 Davis
2005/0011345 A1 1/2005 Herring
2006/0156606 A1 7/2006 Robinson

*Primary Examiner* — Michelle Clement
(74) *Attorney, Agent, or Firm* — Brian S. Steinberger; Phyllis K. Wood; Law Offices of Brian S. Steinberger, P.A.

(57) ABSTRACT

A kit, system and method for modifying an AK-variant firearm to permit bolt carrier pull back by the right or left hand. The kit, system and method includes a receiver cover including an arch-shaped crown and a pair of opposing retaining fins affixed to the bottom of the crown. One retaining fin has a slot that extends along the length of its upper portion. A guide track is affixed to the retaining fin having the slot. A charging handle assembly is secured to the guide track and is slidably engaged with retaining flanges and adapted to move along the guide track. An auxiliary charging handle is affixed to, and projects from, the slide. An engagement pin affixed to the slide projects inwardly to extend through the slot to engage the bolt carrier and move it when the charging handle is pulled.

18 Claims, 16 Drawing Sheets

Fig.5 (PRIOR ART)
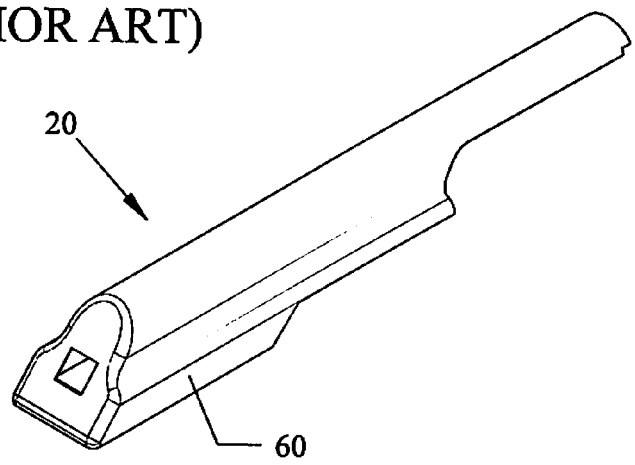
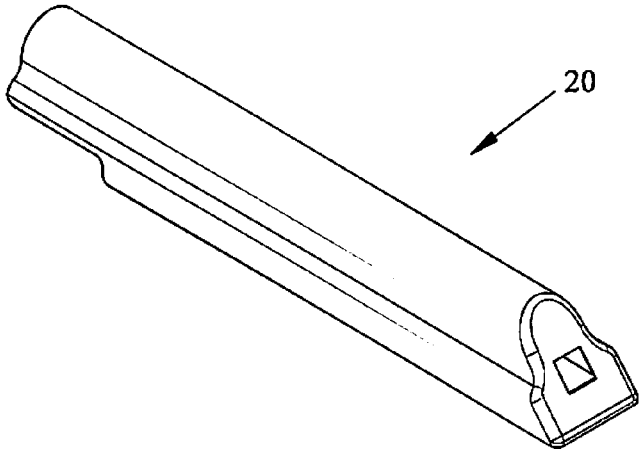
Fig.6
(PRIOR ART)
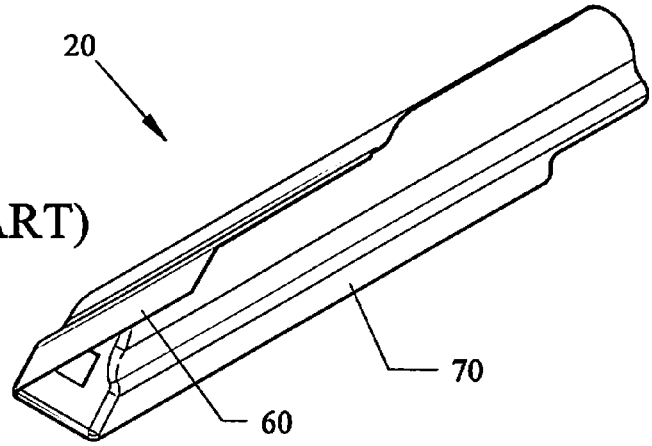
Fig.7
(PRIOR ART)

FIREARM MODIFICATION KIT

This application is a continuation-in-part of U.S. patent application Ser. No. 12/292,770 filed on Nov. 26, 2008, now allowed.

FIELD OF THE INVENTION

The present invention related generally to firearms and, more particularly, to a modification kit, system and method that replaces the conventional receiver cover to modify the charging mechanisms for a AK type model assault rifle, or variant thereof.

BACKGROUND OF THE INVENTION

The Kalashnikov assault rifle, better known as the AK-47, and its variants comprise one of the largest groups of firearms on earth. It has been estimated that over 90 million of these firearms have been produced in dozens of countries since their introduction in the Soviet Union in 1946. Developed primarily as a military weapon, the AK-variant became famous for its simplicity of operation and reliability in extreme conditions of use. Because of its mild recoil, the AK-variant has the capability of delivering effective fire at a range of 400 meters.

The AK-firearm has a few problems that make it less than optimal for use as a weapon of war. One of these, a lack of means to hold the bolt open after the last round is fired from its magazine was solved by the bolt locking mechanism described in U.S. Pat. No. 7,261,029 issued to the same inventor as the subject application. A current unresolved problem, however, involves the construction of an AK type weapon for the exclusive operation of either a right- or a left-handed user. The bolt on the AK-firearm is always on the right side and a right-handed user can have a tough time operating a AK-variant.

For optimum shooting performance, it is important that a user hold an AK-firearm by the pistol grip with his strong hand and while looking at the intended target through the sights. To initiate the firing of an AK-variant firearm, a bullet is driven from a loaded magazine into an empty chamber by grasping the AK-firearm by the pistol grip with the strong hand, pulling the charging handle to the rear with the weak hand, and then releasing the charging handle. If the configuration of an AK-variant firearm causes a user to hold the pistol grip with his weak hand while pulling the charging handle with the users strong hand, the charging process is slowed and a steady aim is lost.

SUMMARY OF THE INVENTION

In view of the problems associated with right- and left-handed variants of the AK-variant assault rifle, it is a primary object of the present invention to provide a kit, system and method that permits a user to readily draw the bolt carrier of an AK-variant rearwardly with either his right hand or his left hand thereby making an AK-variant employing an ergonomic kit, system and method.

A second object of the present invention is to provide a receiver cover modification kit, system and method that replaces the conventional receiver cover of an AK-variant firearm. The modification kit is supplied as an aftermarket product that a user can install in just a few moments and requires no tools.

A third object of the present invention is to provide a receiver cover modification kit, system and method of that will not interfere with normal operation of an AK-variant firearm. Thus, a firearm equipped with the receiver cover modification kit will function normally except that reloading is simplified and speeded-up by permitting a user to move the bolt carrier rearwardly with either his right hand or his left hand.

A fourth object of the present invention is to provide a receiver cover modification kit, system and method with improved features that is lightweight in construction, inexpensive to manufacture, and fully dependable in use.

A first preferred embodiment provides a kit, system and method for modifying a firearm having a receiver, a primary charging handle extending outwardly from only one side of the receiver and a bolt carrier in the receiver.

The kit, system and method includes a modified receiver cover having a crown and a left and right retaining fin integral with a bottom of said crown for engaging the top of the receiver of the firearm, the left retaining fin having an elongated slot extending longitudinally along the left retaining fin on the left side of receiver cover, one single guide track having one single slot affixed to the left retaining fin aligned with the one single receiver cover slot, said guide track having a pair of retaining flanges being disposed on opposite sides of said slot, an auxiliary charging handle assembly secured within the guide track, the auxiliary charging handle assembly including a slide being slidably engaged to slide along the length of the guide track, an auxiliary charging handle and an engagement pin projecting inwardly from the slide and extending through said receiver cover slot to engage the bolt carrier positioned within the receiver of the firearm and move the bolt carrier when the auxiliary charging handle is pulled rearwardly, wherein the bolt carrier of the firearm includes a primary charging handle extending therefrom a direction generally opposite of the auxiliary charging handle and extending outwardly from the receiver cover beneath the retaining fin not having the one single receiver cover slot.

The left and the right the left retaining fins include an upper and a lower retaining fin with the elongated slot in the left retaining fin being located approximately midway between a top and a bottom of upper portion of the left retaining fin. The elongated slot extends from a forward point adjacent the forward most position of travel of a catch surface of the bolt carrier in the firearm receiver to a rearward point adjacent the rearward most position of movement of the front of the catch surface of the bolt carrier.

The guide track includes an elongated base plate that is attached flush against the upper portion of the left retaining fin with the base plate longitudinal slot dimensioned and positioned to be coextensive with the receiver cover slot. The guide track further includes a pair of retaining flanges that extend outwardly from the base plate of the guide track to terminate at free ends remote from retaining fin, the retaining flanges overhanging the guide track base plate along their lengths and defining a pair of opposed grooves for retaining the slide.

The auxiliary charging handle assembly includes a handle retaining tab as part of a top of the slide, a foldable auxiliary charging handle pivotally attached to the handle retaining tab by a pivot pin to fold the auxiliary charging handle a stowage position against the modified receiver cover, and a handle retaining tab to limit a range of pivoting motion of the foldable auxiliary charging handle. The slide includes an elongated guide body and a pair of retaining arms affixed to the opposite sides of the elongated guide body that extend outwardly from the guide body to terminate at free ends adjacent to the pair of opposed grooves in the guide track.

Another preferred embodiment provides a method for modifying a firearm having a receiver and a bolt being positioned in the receiver. The method includes providing a modified receiver cover having a crown and a left and a right retaining fin extending outwardly and downwardly from a bottom of each side of the crown to mate with the receiver of the firearm and an elongated receiver slot extending longitudinally along the left retaining fin of the receiver cover, attaching a guide track having a longitudinal slot aligned with the receiver slot to the left retaining fin, providing a slide having an auxiliary charging handle extending outwardly in one direction away from the slide and a charging pin extending outwardly in an opposite direction away from the slide, slidably securing the slide within the guide track with the charging pin extending through the longitudinal slot into the receiver of the firearm and the auxiliary charging handle extending outwardly from the receiver cover, removing a receiver cover from the receiver of the firearm, and attaching the modified receiver cover to the receiver of the firearm with the auxiliary charging handle extending outwardly from the left side of the modified receiver cover in a direction opposite of the primary charging handle extending outwardly from a right side of the firearm receiver.

The step of providing a modified receiver cover includes forming a U-shaped crown, attaching the left and a right retaining fins to a left and right leg of the U-shaped crown, each of the left and right retaining fin having an upper portion and a lower portion, cutting the longitudinal receiver slot approximately midway between the top and bottom of the upper portion of the left retaining fin, and attaching a back wall cover to one end of the U-shaped crown and left and right retaining fins, the back wall cover having a rectangular hole to receive a recoil spring base.

The step of attaching a guide track includes forming a guide track having a guide track base plate with a longitudinal slot therein and a pair of retaining flanges that extend outwardly along the length of each side of the base plate and overhanging the guide track base forming opposing grooves approximately parallel with the longitudinal slot and aligning the guide track longitudinal slot to be coextensive with the receiver slot.

The step of proving a slide includes forming a slide body with a pair of retaining arms that extend from the guide body to terminate at free ends adjacent to the opposing groves in the slide track for slidable movement and attaching the charging pin to the slide body with the charging pin extending outwardly through the receiver slot into the receiver of the firearm to contact with the catch surface of the bolt carrier.

Further objects and advantages of this kit, system and method will be apparent from the following detailed description of preferred embodiments which are illustrated schematically in the accompanying drawings.

BRIEF DESCRIPTION OF THE DRAWINGS

FIG. 5 is a top right perspective view of a prior art receiver cover.

FIG. 6 is a top left perspective of the AK-variant shown in FIG. 5.

FIG. 7 is a bottom right perspective view of the AK-variant shown in FIG. 6.

Similar reference characters denote corresponding features consistently throughout the accompanying drawings.

DESCRIPTION OF THE PREFERRED EMBODIMENTS

Figure 1:
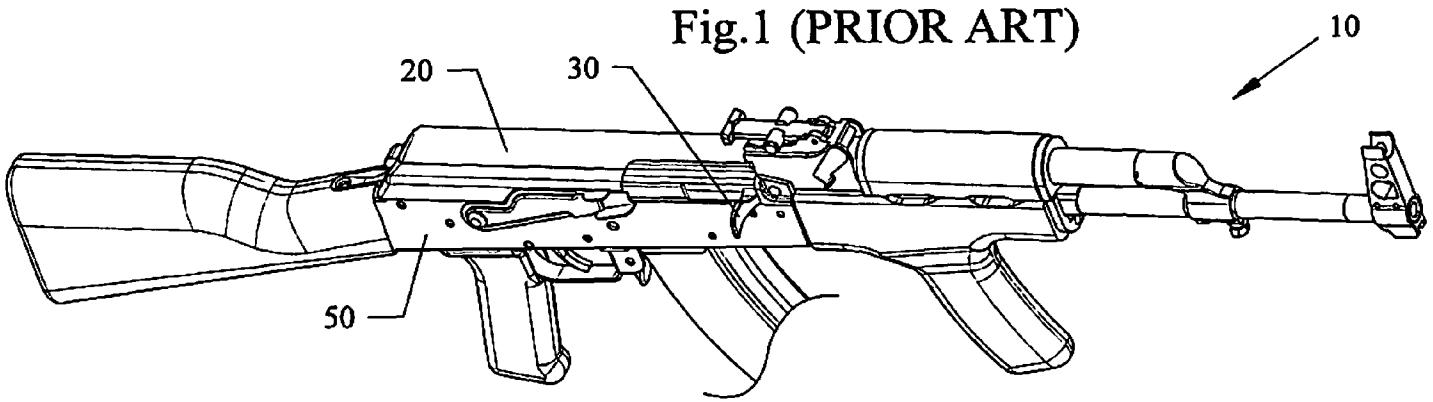
Fig.1 (PRIOR ART)
FIG. 1 is a top right perspective view of a prior art AK-variant rifle showing the charging lever in a forward position.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

The following is a list of reference numerals used in the description and the drawings to identify components:

10 AK-variant rifle
20 Receiver cover
22 Back wall

Figure 2:
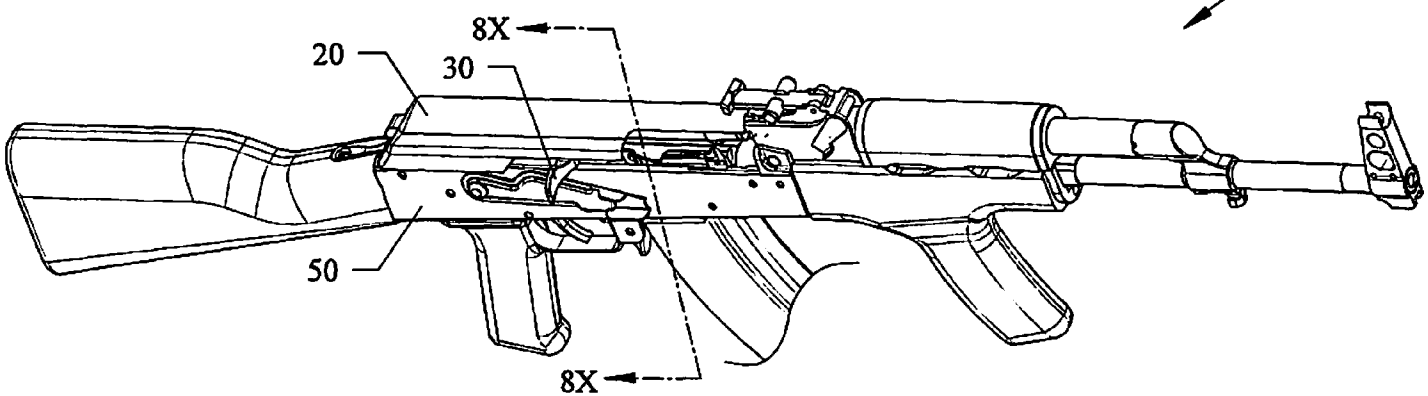
Fig.2 (PRIOR ART)
FIG. 2 is a top right perspective view of an AK-variant rifle showing the charging lever in a pulled back position.
Figure 3:
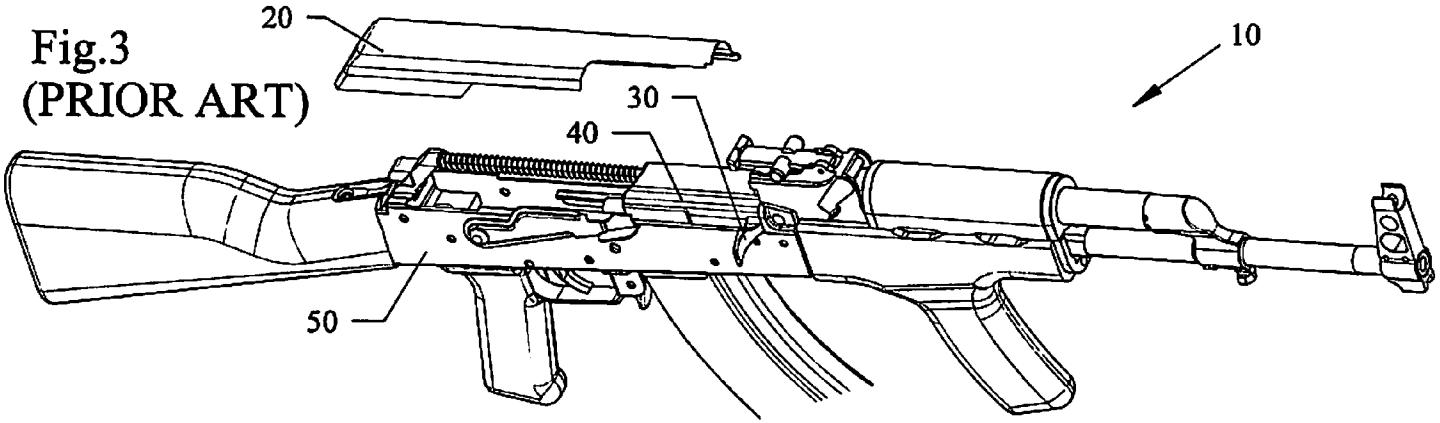
Fig.3 (PRIOR ART)
FIG. 3 is the AK-variant shown in FIG. 1 with the receiver cover removed.
Figure 4:
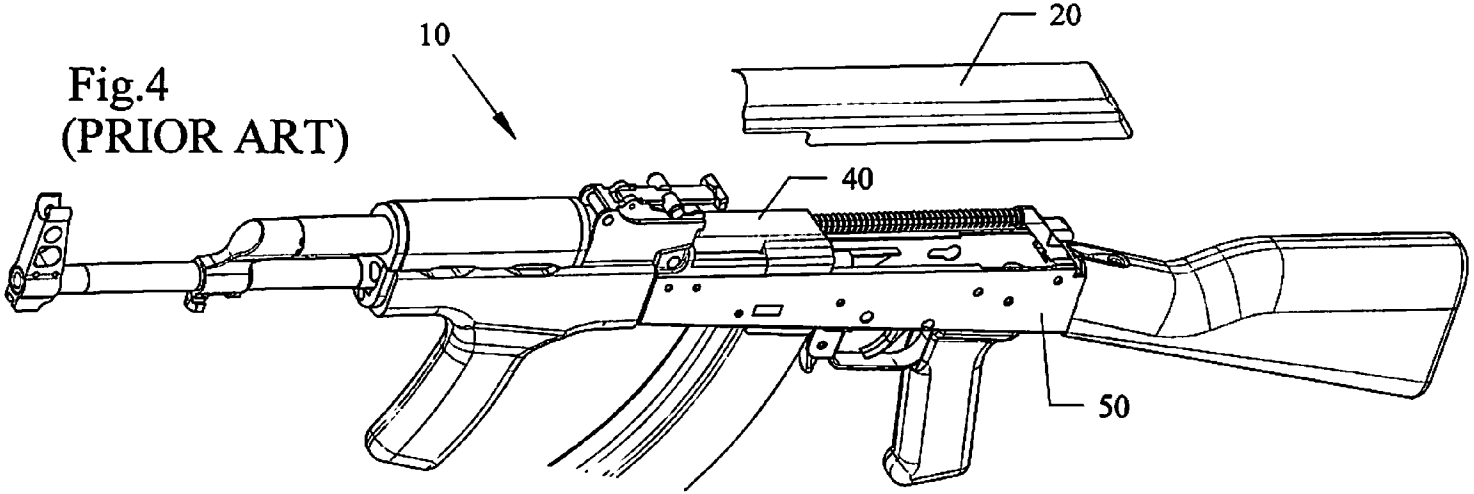
Fig.4 (PRIOR ART)
FIG. 4 is a top left perspective of the AK-variant shown in FIG. 1 with the receiver cover removed.

25 Crown
30 Primary charging handle
40 Bolt carrier
45 tubular sleeve
50 Receiver
60 Right retaining fin
63 Upper right retaining fin
65 Lower right retraining fin
70 Left retaining fin
73 Upper left retaining fin
75 Lower left retraining fin
80 AK modification kit
90 Modification kit receiver cover
100 Guide track
102 slide track groves
105 Retraining flanges
110 Folding auxiliary charging handle
120 Charging pin
130 Slot in receiver cover
140 Holes to weld guide track to receiver cover.
150 Slide
155 retaining arms
160 Aux handle pivot pin
170 Modified AK-variant rifle
180 Catch surface of bolt carrier
182 bolt carrier base block
185 longitudinal bore
190 Retaining pin
200 Ball spring plunger
210 Lock pin
220 Lock pin spring
230 Detent in slide FIG. 1 is a top right perspective view of a prior art AK-variant rifle (hereinafter firearm) showing the charging lever in a forward position and FIG. 2 shows the charging lever in a pulled back position. As shown, the prior art firearm 10 includes a receiver 50, a receiver cover 20, and a primary charging handle 30. FIGS. 3 and 4 are top right and left perspective views, respectively, of the firearm 10 showing the receiver 50 with the receiver cover 20 removed exposing the bolt carrier 40.

FIGS. 5 and 6 are top right and left perspective views, respectively, of a prior art receiver cover and FIG. 7 shows a bottom right perspective view of the firearm 10 receiver cover 70. As shown in FIGS. 5-7, the prior art receiver cover 20 is elongated and arch-shaped, being adapted to snugly, yet slidably, enclose bolt carrier 40 therein as shown in FIGS. 3 and 4. A crown 25, having a configuration resembling that of an inverted "U", defines the top of the arch. A pair of retaining fins 60 and 70 are affixed to the bottom of sides of the crown 25 of the inverted "U" and defines the bottom of the arch, or the two legs of the inverted "U". Each of the right and left retaining fins 60 and 70 has an upper portion 65, 75 that extends outwardly and downwardly from a respective one of the opposed sides of crown 25 to provide clearance for bolt carrier 40. Each of the right and left retaining fins 60 and 70 also has a lower portion 65, 75 that extends downwardly from the bottom of its associated, upper portion 63, 73 for engaging the top of the firearm receiver 50. A back wall 22 closes the rear portion of the arch and is affixed to crown 25 of the inverted "U" as well as upper 63 and 73 and lower 65 and 75 portions of both retaining fins 60 and 70.

Figure 8:
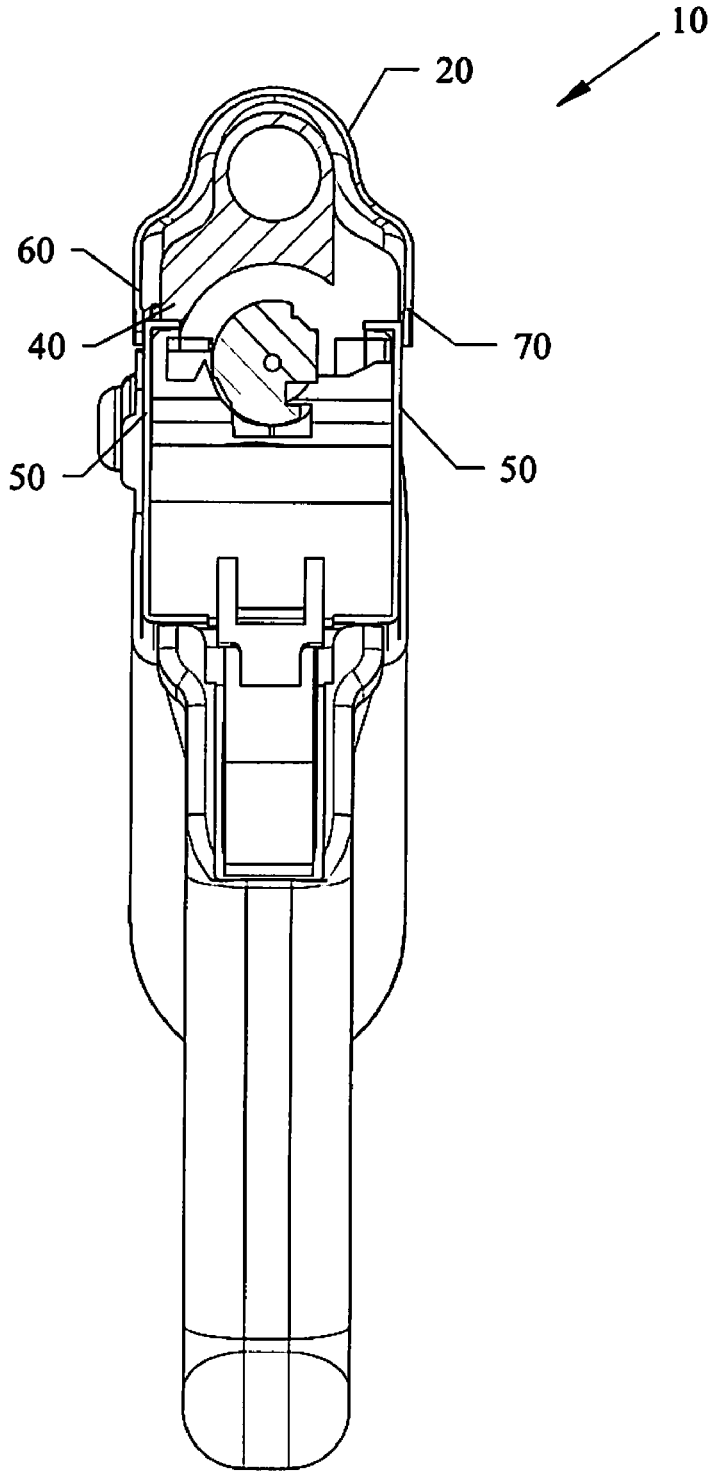
Fig.8 (PRIOR ART)
FIG. 8 is a section view showing the receiver cover fit to the receiver and bolt carrier position relative to cover.

FIG. 8 is a section view showing the prior art firearm 10 receiver cover 20 fit to the receiver 50 and bolt carrier 40 position relative to the receiver cover 20. As shown, the right and left retaining fins 60 and 70 connect with the right and left sides of the receiver 50 with the bolt carrier within the receiver cover 20.

Figure 9:
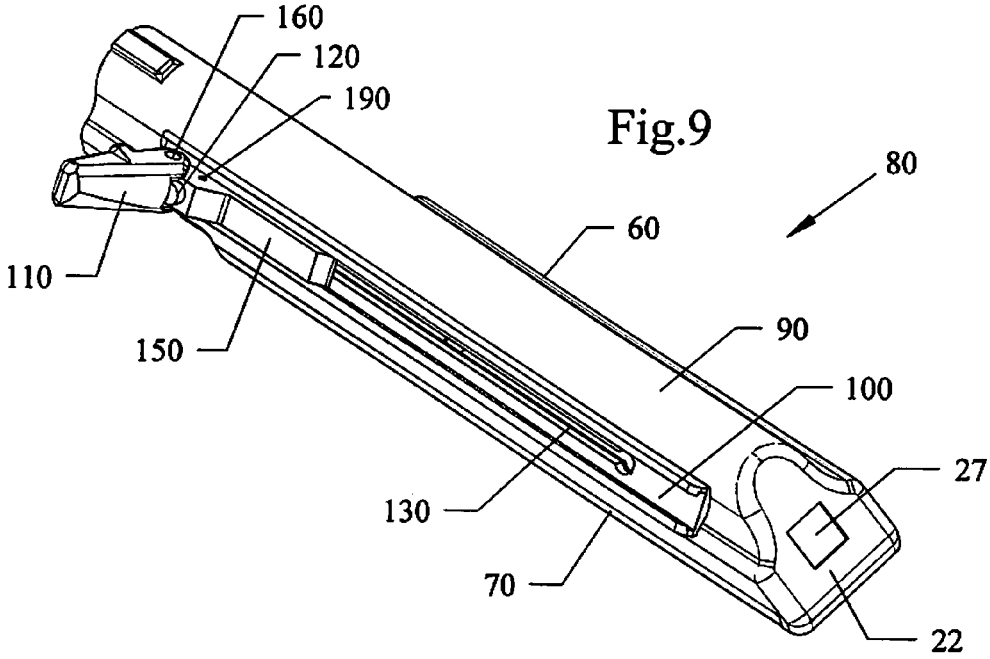
FIG. 9 is a top left perspective view of a modification kit showing the auxiliary handle up and forward.
Figure 10:
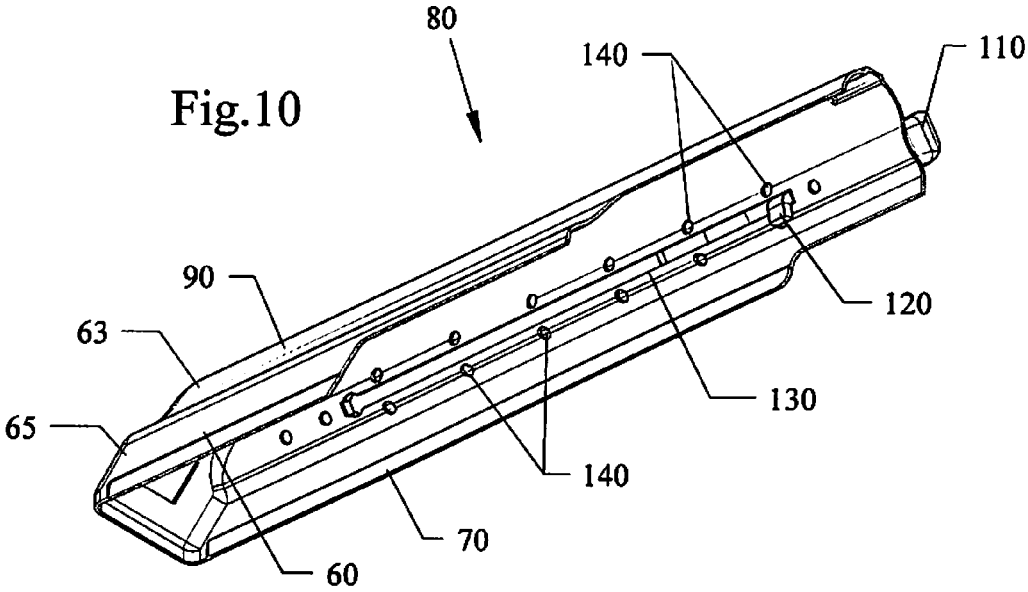
FIG. 10 is a bottom right perspective view of FIG. 9.

Referring now to FIGS. 9 and 10, a firearm modification kit in accordance with the present invention is shown generally at 80. The kit 80 includes a modified receiver cover 12 and an auxiliary charging handle of improved form. The kit 80 is installed on an AK-47 assault rifle, or variant thereof, hereinafter referred to as a "firearm" and, after installation, becomes an integral part of the firearm. A variant of an AK-47 is described in U.S. Pat. No. 7,261,029, issued Aug. 28, 2007 to the same inventor, which is incorporated herein for its description of a firearm adapted for use with kit 10. A variation of the firearm modification kit is described in U.S. patent application Ser. No. 12/292,770 filed on Nov. 26, 2008, now U.S. Pat. No. 8,117,954 by the same inventor, which is incorporated herein by reference.

FIGS. 9 and 10 are a top left and bottom left, respectively, perspective views of a modification kit 80 showing the auxiliary handle up and forward. The modification kit receiver cover 90 is provided with a number of openings. An elongated slot 130 extends longitudinally along the retaining fin 70 on the left side of receiver cover 80. Specifically, slot 130 is located approximately midway between the top and bottom of upper portion 73. Slot 130 extends from a forward point adjacent the forward most position of travel of the catch surface 180 of bolt carrier 40 (described more fully herein below) in the firearm receiver to a rearward point adjacent the rearward most position of movement of the front of catch surface 180 of the bolt carrier 40 in the receiver 50. A rectangular hole 27 is also provided in the center of back wall 22 for receiving a recoil spring base.

Still referring to FIGS. 9 and 10 guide track 100 is affixed to the left retaining fin 70. The guide track 100 has an elongated, base plate that is positioned flush against the upper portion 73 of the left retaining fin 70. The base plate has a longitudinal slot 130 therein that is dimensioned and positioned so as to be coextensive with the receiver slot. The base plate of the guide track 100 serves to reinforce retaining fin 70 in the area around slot 130.

Figure 23:
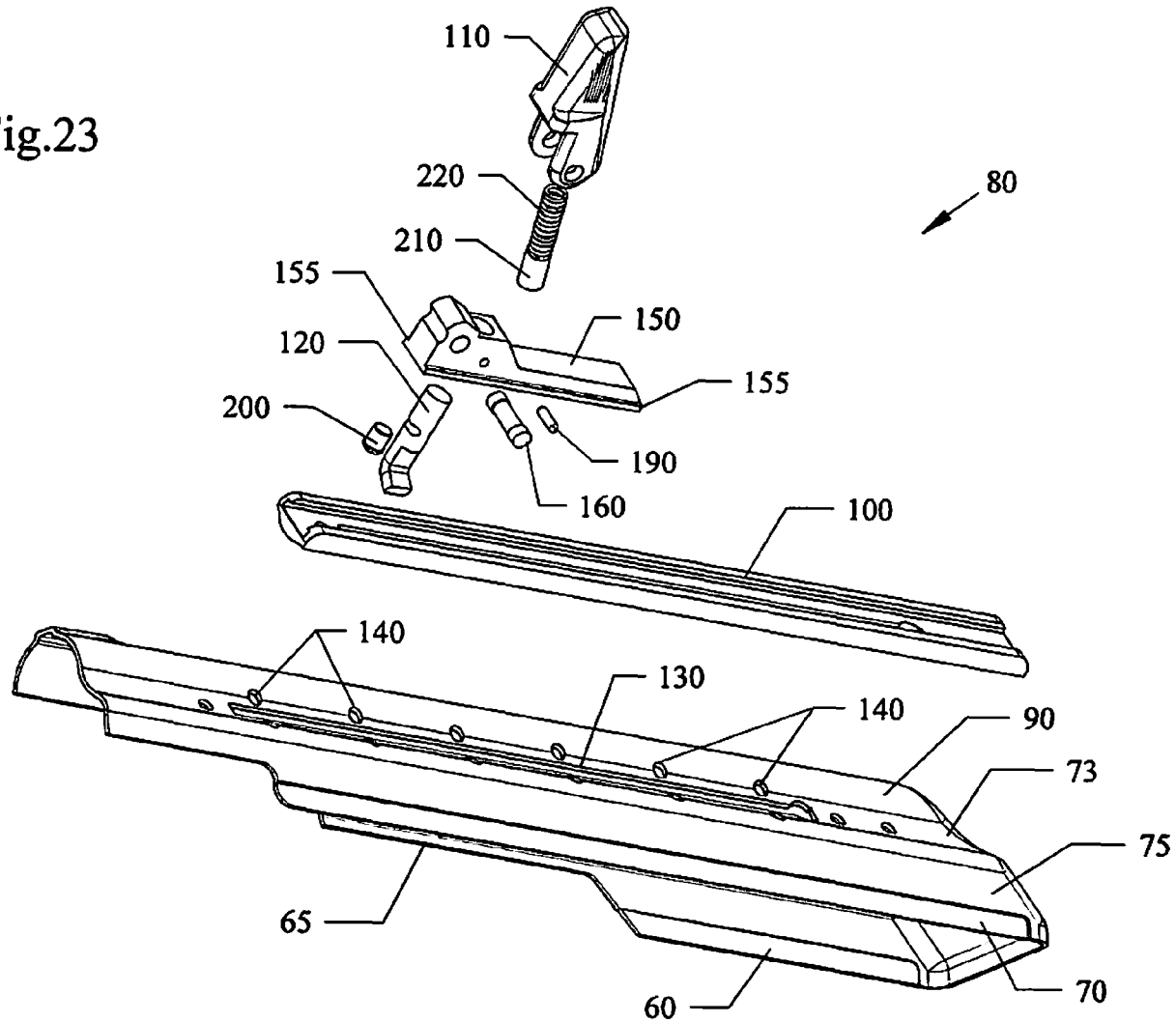
FIG. 23 is an exploded view of the modification kit according to the present invention.

The guide track 100 includes holes to weld the guide track 100 to the receiver cover 90. The guide track 100 includes a guide track base plate and a pair of retaining flanges 105 that extends outwardly from the base of the guide track 100 so as to terminate at free ends remote from retaining fin 70. Each of the retaining flanges 105 tapers in terms of its width such that it is widest at its free end and narrowest along its connection to guide track base plate. The taper results in retaining flanges 105 in terms of its width such that it is widest at its free end and narrowest along its connection to guide track base plate. The taper results in retaining flanges 105 both overhanging guide track base plate along their lengths and defining a pair of opposed grooves 102 (FIG. 23).

A folding auxiliary charging handle assembly 110 travel in the guide track 100. The folding auxiliary charging handle assembly 110 includes a slide 150 that is moved in the opposed grooves 102 formed by the retraining flanges 105 along the length of guide track 100 and an auxiliary charging handle 110 that is pivotally secured to the slide 150. As shown, the auxiliary charging handle assembly includes charging handle pivot pin 160 that allows the charging handle 110 to fold, a charging pin 120 that extends through the slot 130 in the receiver cover 90 and a retaining pin 190. When not needed, auxiliary charging handle 110 can be pivoted (folded) to a stowage position against receiver cover 90 to facilitate the easy handling and transport of the modified firearm 170.

Figure 11:
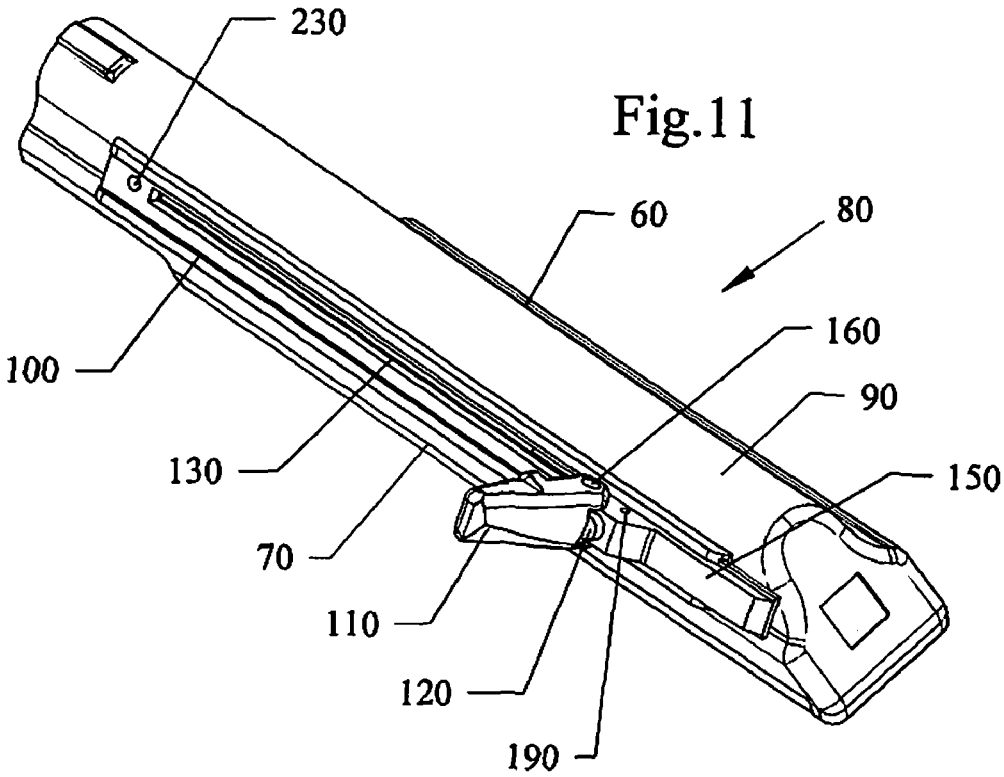
FIG. 11 shows the AK-variant of FIG. 9 with the auxiliary handle up and pulled back.
Figure 12:
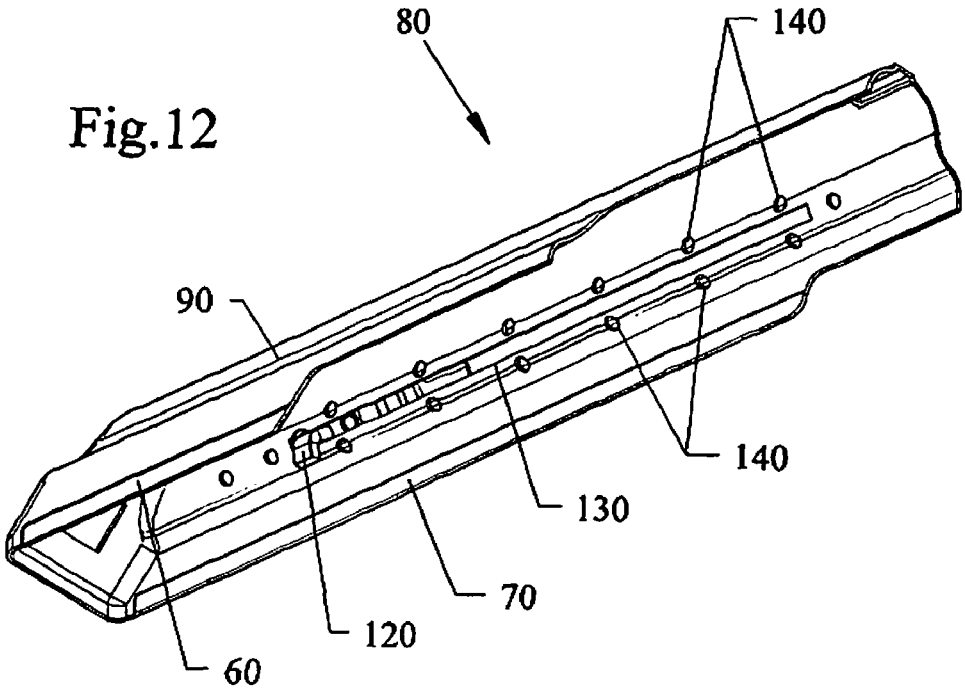
FIG. 12 is a bottom right perspective view of the AK-variant shown in FIG. 11.

Referring to FIGS. 11 and 12, the slide 150 engages the guide track 100 and has an elongated guide body that is positioned between retaining flanges 105 of guide track 100. As shown in FIG. 23, affixed to the opposite sides of guide body is a pair of retaining arms 155 that extends from the guide body 150 so as to terminate at free ends adjacent grooves 102 in the guide track 100. One of a pair of retaining fingers is affixed to the free end of each of retaining arms 155. Each of the retaining fingers projects outwardly from a respective one of the retaining arms 155 and into a respective one of the slide track grooves 102. Retaining fingers of the retraining flanges 155 are adapted for slidable movement in slide track grooves 102.

Slide 150 further includes a handle retaining tab as part of the top of guide body 150. The handle retaining tab projects outwardly from guide body 150 away from guide track 100. The auxiliary charging handle 110 is pivotally secured to the handle retaining tab via the auxiliary handle pivot pin 160. Referring to FIG. 23, the auxiliary charging handle assembly includes the charging handle 110, a lock pin 210 and lock pin spring 220 that mates with the slide and is secured with a retraining pin 190. The assembly also includes the auxiliary handle pivot pin 160 that allows the charging handle 110 to fold.

Figure 13:
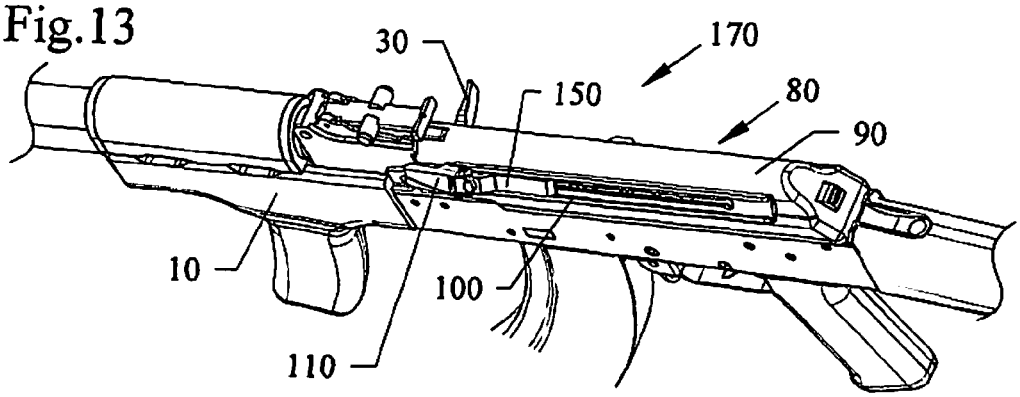
FIG. 13 is a top left perspective view of the modification kit installed on an AK-variant rifle with the auxiliary handle shown folded down and forward.
Figure 14:
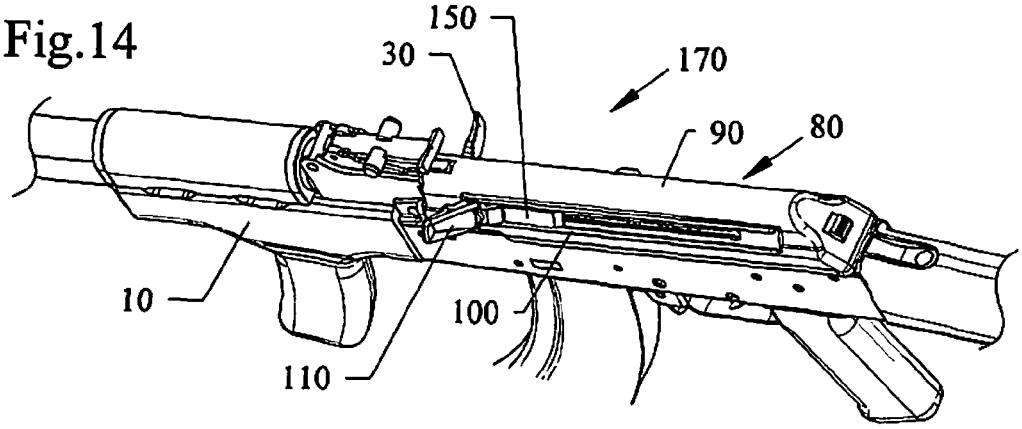
FIG. 14 shows the AK-variant of FIG. 13 with the auxiliary handle shown up.
Figure 15:
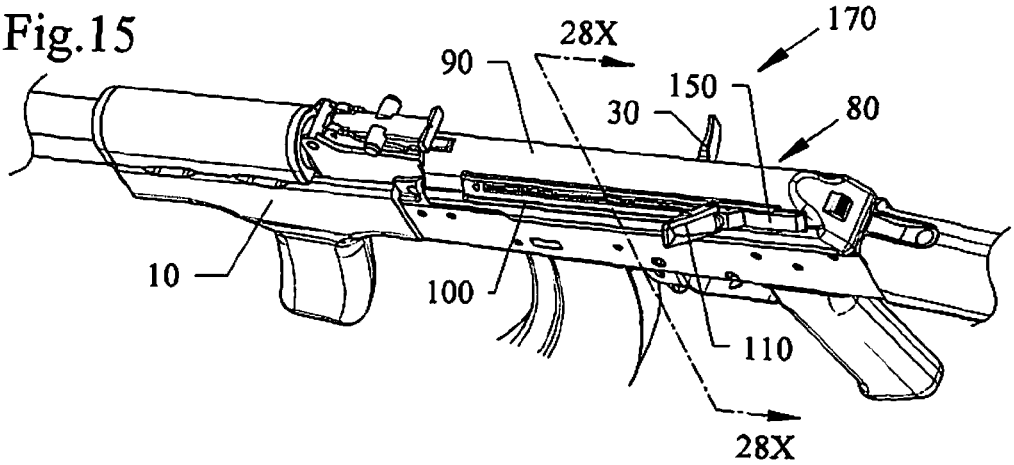
FIG. 15 shows the AK-variant of FIG. 14 showing the primary charging handle and auxiliary handle pulled back.

Still referring to FIG. 23, the auxiliary charging handle 110 includes a handle body from with a pair of handle retaining fins 115 extending outwardly therefrom. The retaining fins 115 are respectively pivotally affixed to the slide handle retaining tab by means of a pivot pin 160. The charging handle body tapers toward its outer free end that, when handle 110 is pivoted fully toward guide track 100, is located a small distance from upper portion of left retaining fin 73 so that a finger of a user can easily pivot the charging handle 110 outwardly. When pivoted outwardly, the auxiliary charging handle 110 abuts against handle retaining tab to limit the range of pivoting motion of auxiliary charging handle 110 to approximately 90°. FIG. 13 is a top left perspective view of the modification kit installed on an AK-variant rifle with the auxiliary handle shown folded down and forward and FIG. 14 and show the right side primary charging handle 30 and left side folding auxiliary charging handle 110 up.

Figure 16:
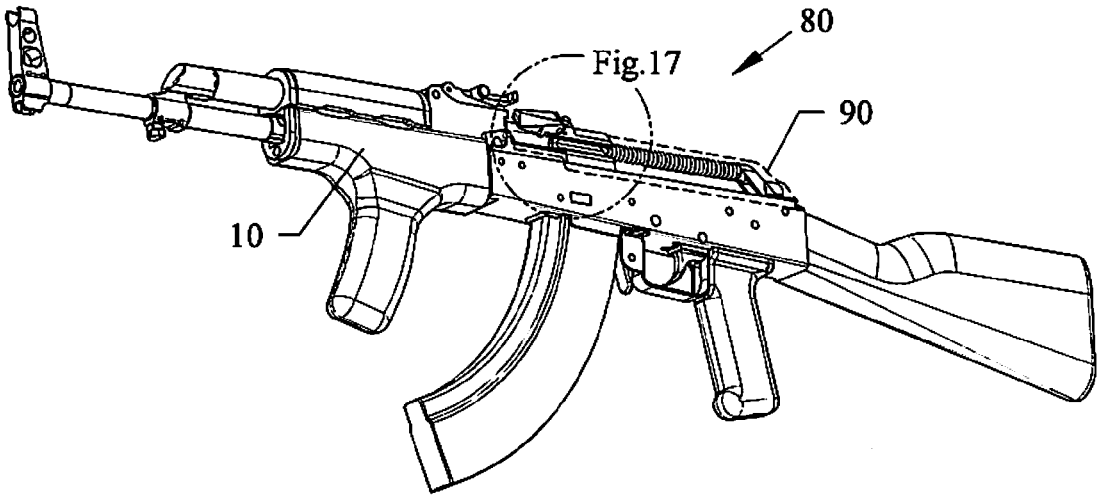
FIG. 16 is a bottom left perspective view of FIG. 13 with the receiver cover not shown so internal detail can be seen; the auxiliary charging handle is shown forward and folded down.
Figure 17:
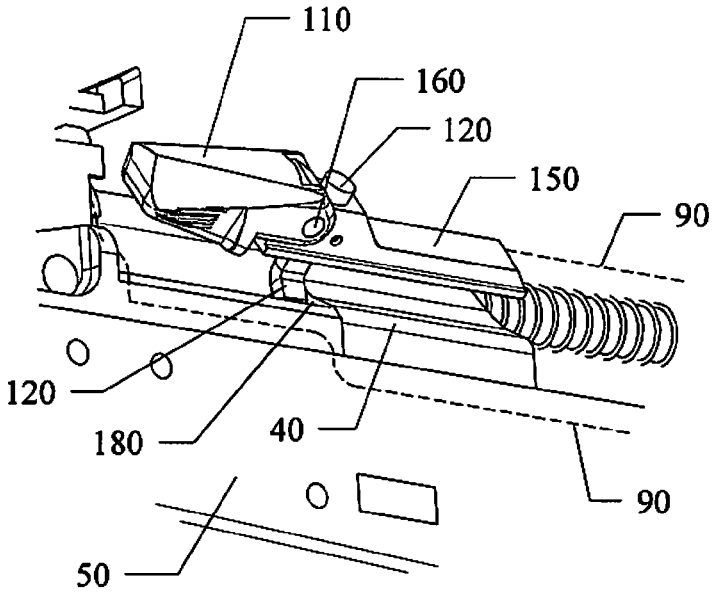
FIG. 17 is an enlarged detail view of FIG. 16.
Figure 18:
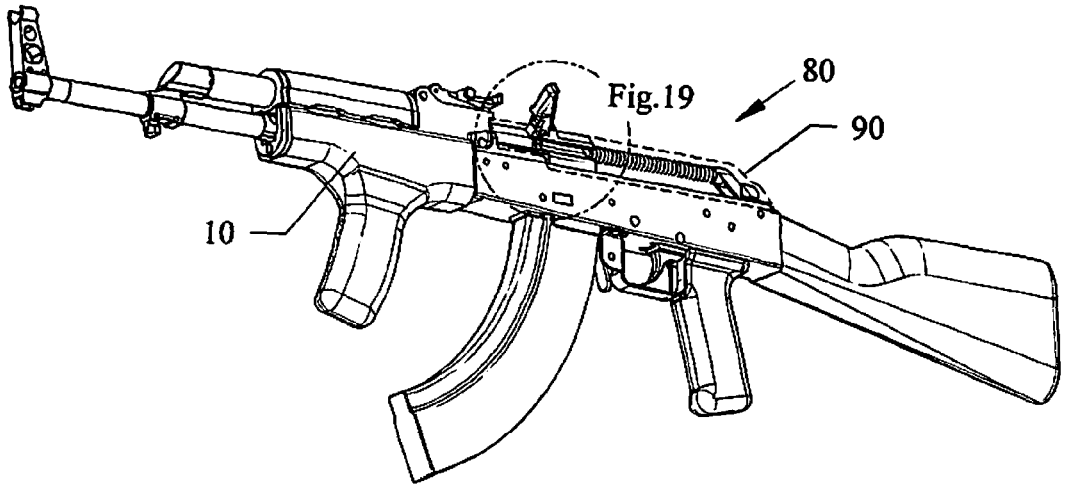
FIG. 18 shows the AK-variant of FIG. 16 with auxiliary charging handle up.
Figure 19:
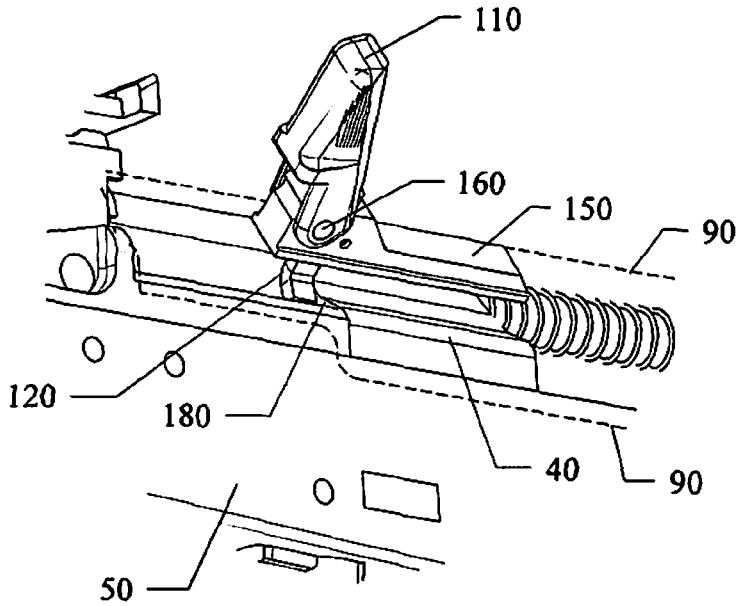
FIG. 19 is an enlarged detail view of FIG. 18.
Figure 20:
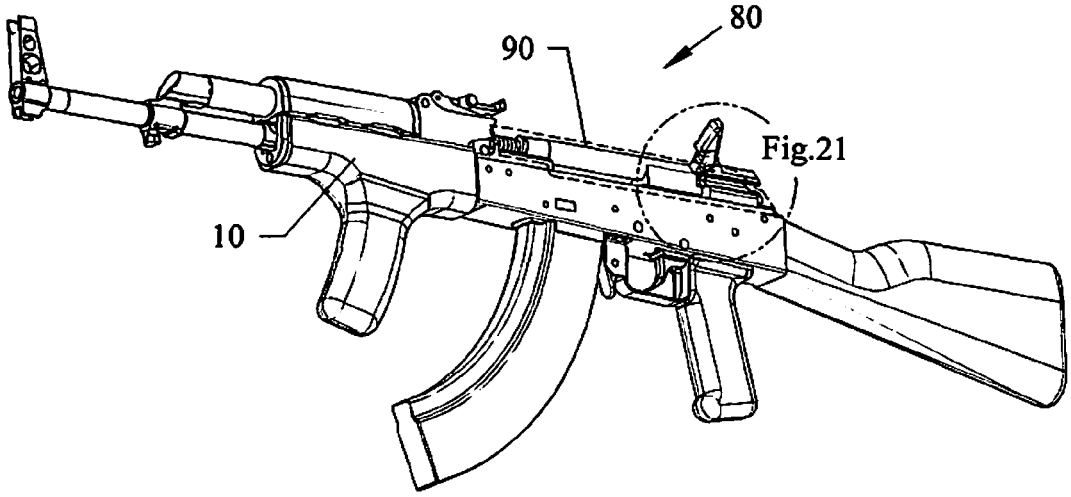
FIG. 20 shows the AK-variant of FIG. 18 with the auxiliary charging handle pulled back.
Figure 21:
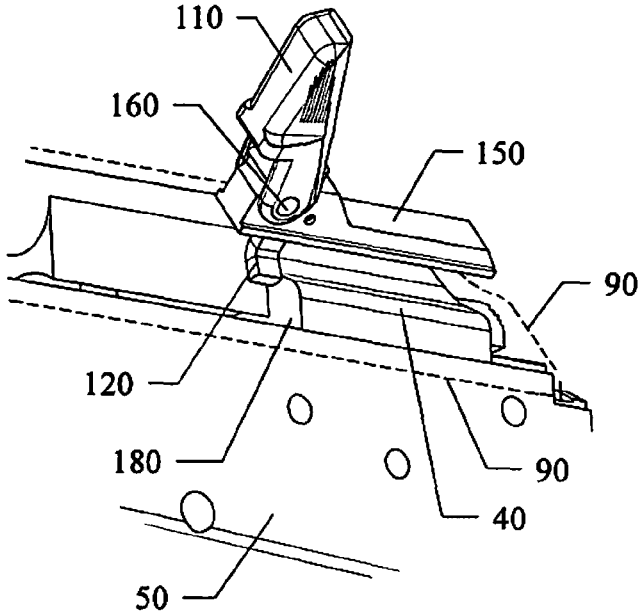
FIG. 21 is an enlarged detail view of FIG. 20.

FIG. 16 is a bottom left perspective view of FIG. 13 with the receiver cover not shown so internal detail can be seen. In FIG. 16 the auxiliary charging handle 110 is shown forward and folded down. FIG. 17 is an enlarged detail view of FIG. 16. FIG. 18 shows the firearm 170 of FIG. 16 with auxiliary charging handle up and FIG. 19 is an enlarged detail view of FIG. 18. Referring to FIGS. 16-19, the bolt carrier 40 moves a bolt within the receiver of the modified firearm 170. The charging pin 120 connected with the auxiliary charging handle 110 engages the bolt carrier 40 catch surface 180. FIG. 20 shows the modified firearm 170 with the auxiliary charging handle 110 pulled back and FIG. 21 is an enlarged detail view of FIG. 20.

Figure 22:
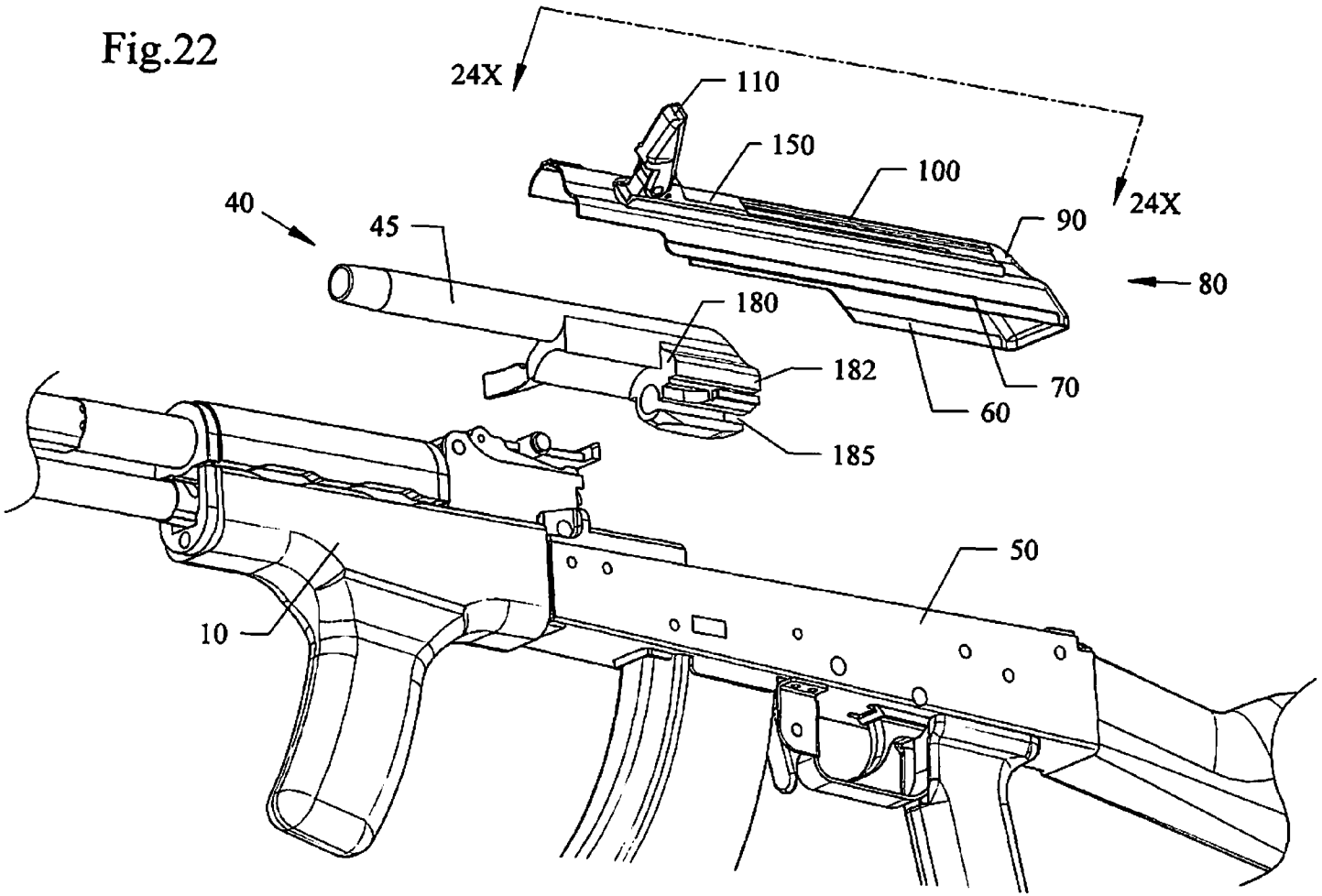
FIG. 22 is an exploded perspective view showing a rifle with the bolt carrier (prior art) and the modification kit disassembled from the rifles receiver.

FIG. 22 is an exploded perspective view showing a rifle 10 with the bolt carrier 40 (prior art) and the modification kit 80 disassembled from the rifles receiver 50. As shown, the bolt carrier 40 is connected with the primary charging handle 30 and engages the catch surface 180 of the bolt carrier 40. The modification kit receiver cover 90 is shown with the guide track 100, the auxiliary charging handle 110 and slide 150 installed. The modified receiver cover 90 covers the bolt carrier 40 such that the charging pin 120 connected with the auxiliary charging handle 110 and slide 150 engages with the catch surface 180 of the bolt carrier 40. The bolt carrier 40 includes a base block 182 having longitudinal grooves in its opposite sides for slidably engaging carrier guides in the receiver. A longitudinal bore 185 passes through base block 182 and is sized to receive the firearm bolt. A tubular sleeve 45 is affixed to the top of base block 182 and extends forwardly from base block 182. Sleeve 45 receives a recoil spring and a spring guide (shown in FIG. 17) within its confines. Beneath sleeve 45 and forwardly of bore 185, bolt carrier 40 is provided with a slotted guideway that receives a stud extending from the bolt.

A primary charging handle 30 is affixed to the right side of the guideway and projects laterally from the guideway. Charging handle 30 reciprocates outside of the receiver when the firearm is fired.

A catch 180 projects from the left side of bolt carrier 40 for selective engagement with charging pin 120. As shown, catch 180 has a configuration resembling that of a reversed "L". Catch 180 has a horizontal member 84 that is affixed to both the front and top of base block 182. Catch 180 also has a vertical member that projects upwardly from the rear of horizontal member and flush with tubular sleeve 45 to which vertical member is affixed. Catch 180 is made by integrally casting it with the remainder of bolt carrier 40 or by adding it later by means of penetrating fasteners, welding or brazing.

Referring to FIG. 23, the AK modification kit 80 includes a modification kit receiver cover 90 that includes right and left retaining fins 60 and 70. The guide track 100 is mounted such that the elongated slot in the guide track mates with the an elongated slot 130 in the upper left retaining fin 173 and is welded in place using the holes 140 in the modified receiver cover 90.

Figure 24:
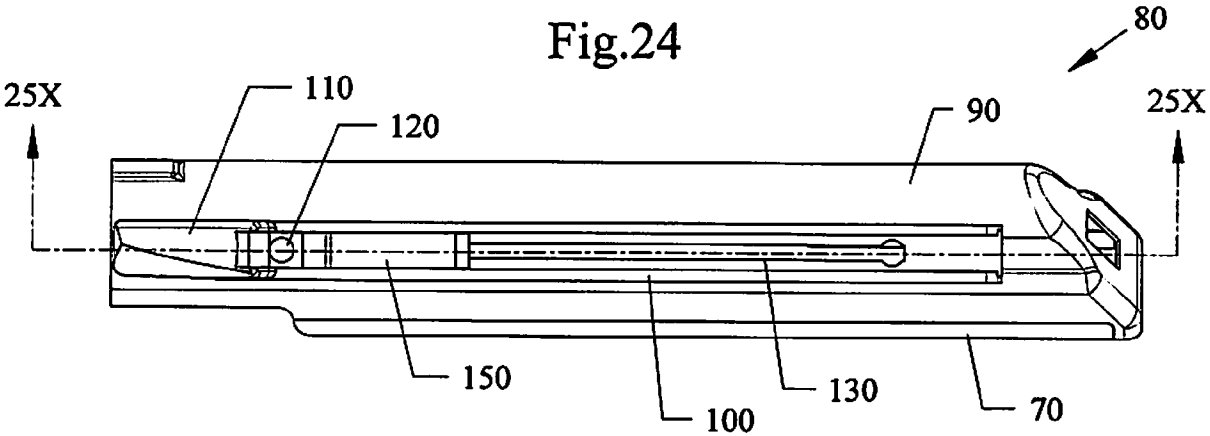
FIG. 24 is a top left view of the modification kit with the handle forward and folded down.
Figure 25:
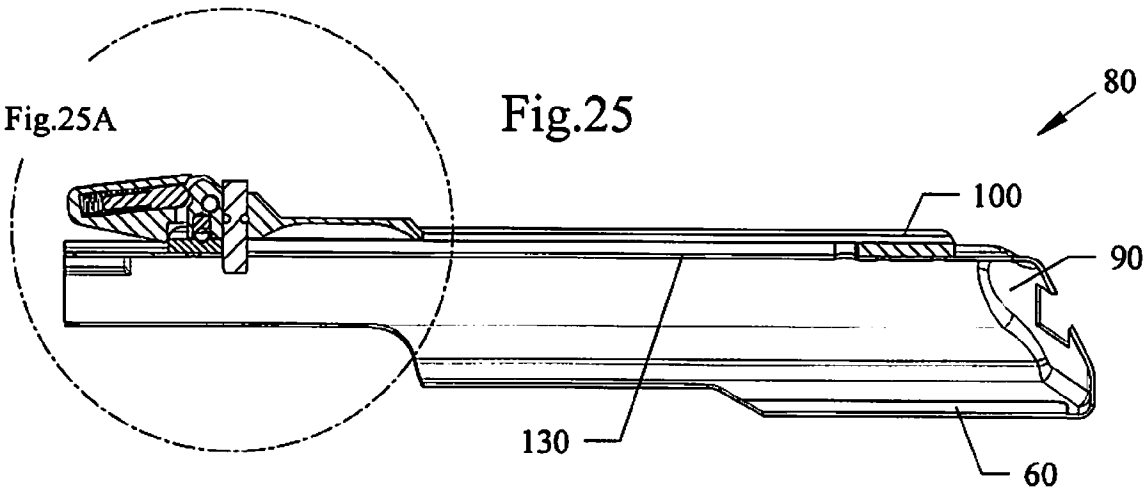
FIG. 25 is a section view of FIG. 24.
Figure 25A:
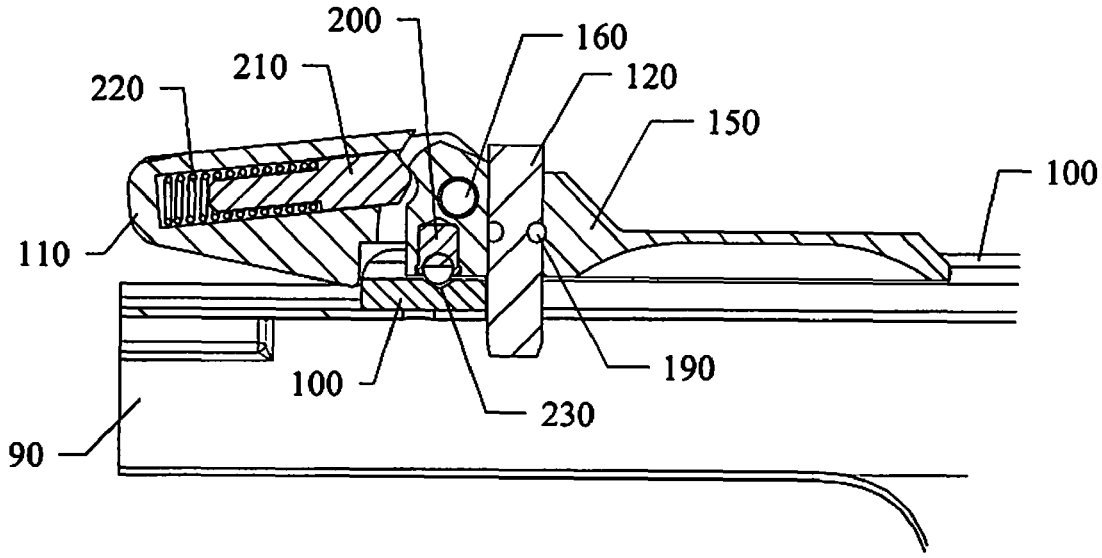
FIG. 25A shows enlarged detail of a section of FIG. 25 marked as FIG. 25A.

FIG. 24 is a top left view of the modification kit with the handle forward and folded down, FIG. 25 is a section view of FIG. 24 and FIG. 25A shows enlarged detail of a section of FIG. 25 marked as FIG. 25A. Referring to FIGS. 23-25A, FIG. 23 shows an exploded view of the auxiliary charging handle assembly that includes the slide 150 with retaining arms 155 extending longitudinally outward to mates with the slide track grooves 102 for sliding the slide 150 within in the guide track 100. A charging pin 120 is attached with the slide 150 using one or more retaining pins 190. Adjacent to the charging pin 120 is a ball spring plunger 200 that mates with a detent 230 in the slide 150 to secure the slide in place until sufficient force is applied to the charging handle 110 to dislocate the ball spring plunger 200 from the detent 230. A lock pin 210 and lock pin spring 220 reside within the auxiliary charging handle 110 in contact with an upper surface of the slide 150 to limit the travel of the folding auxiliary charging handle 110 from its folded position shown in FIG. 25A to a fully extended position shown in FIG. 27A.

Figure 27A:
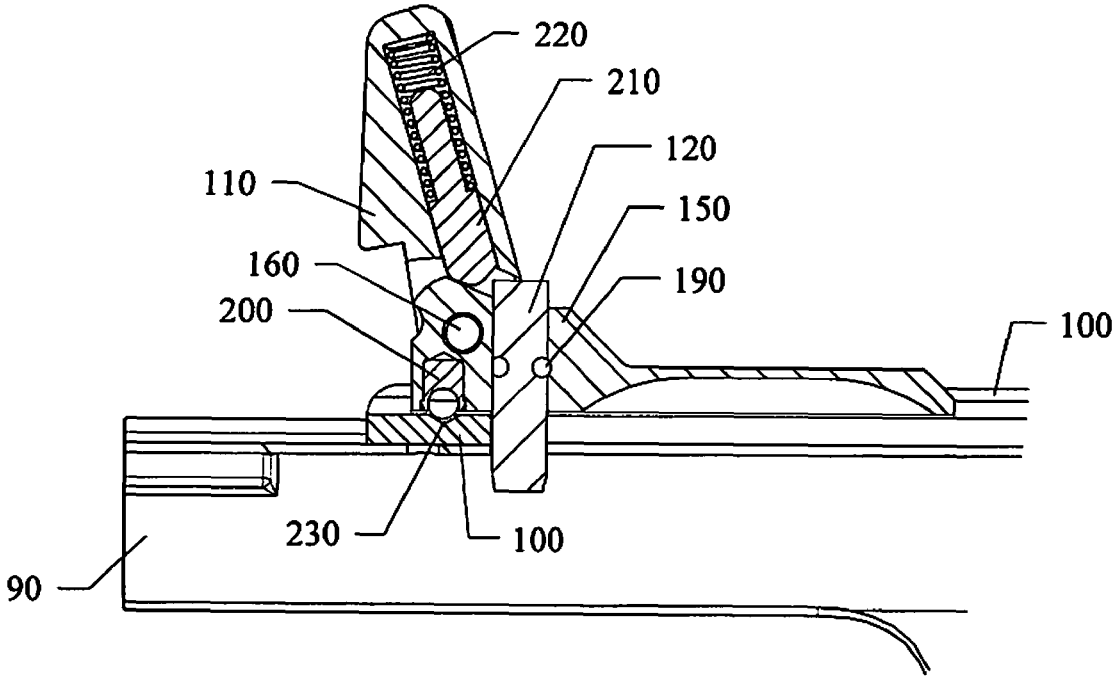
FIG. 27A show an enlarged detail of the area in FIG. 27 labeled as FIG. 27A.
Figure 26:
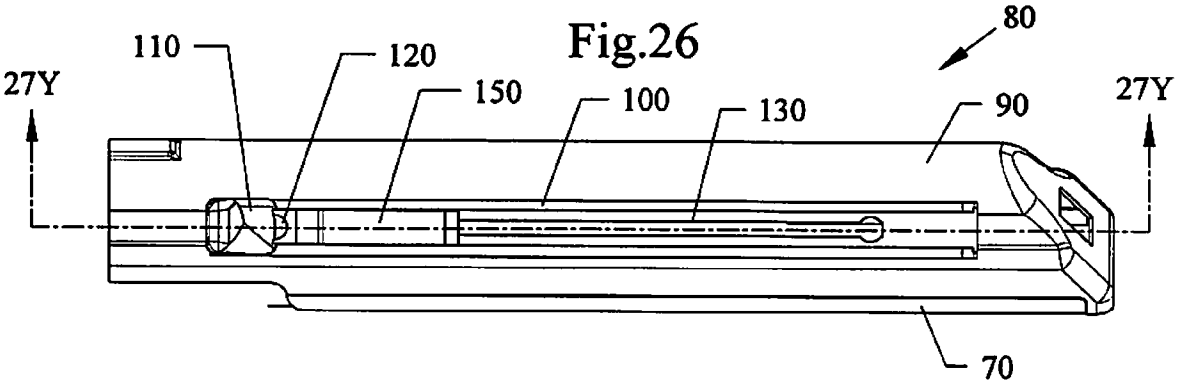
FIG. 26 shows the modification kit of FIG. 24 with the handle up.
Figure 27:
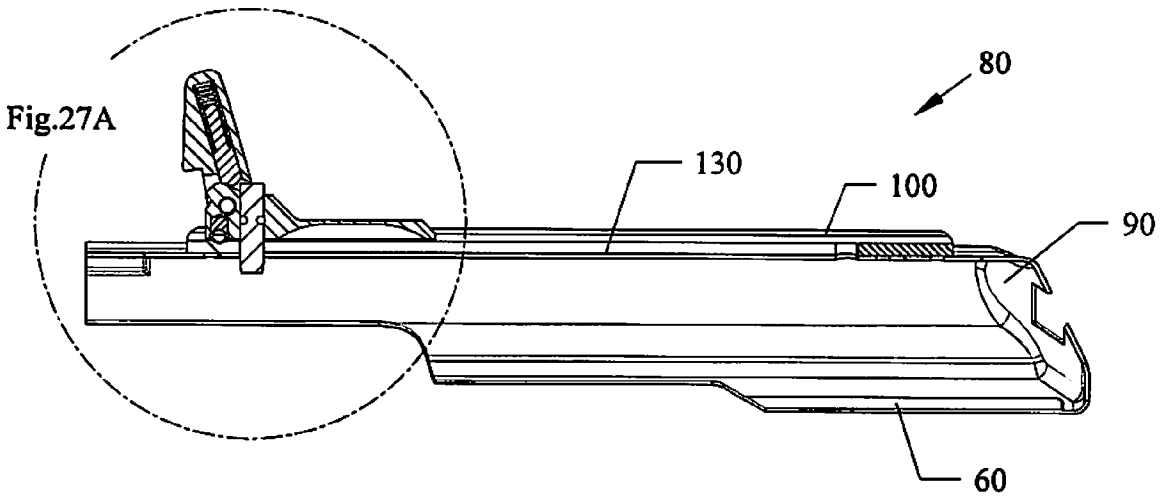
FIG. 27 is a section view of the modification kit shown in FIG. 26.

FIG. 26 shows the modification kit of FIG. 24 with the handle up; FIG. 27 is a section view of the modification kit shown in FIG. 26; and FIG. 27A show an enlarged detail of the area in FIG. 27 labeled as FIG. 27A. As shown in FIG. 25A, when the folding auxiliary charging handle 110 is folded down, the charging handle 110 butts against the receiver cover 90 to prevent the slide 150 from moving. The lock pin 210 secures the auxiliary charging handle 110 in the folded position shown in FIG. 25A and in the upright position shown in FIG. 27A until sufficient force is applied to the auxiliary charging handle to rotate the charging handle to an opposite position.

Figure 28:
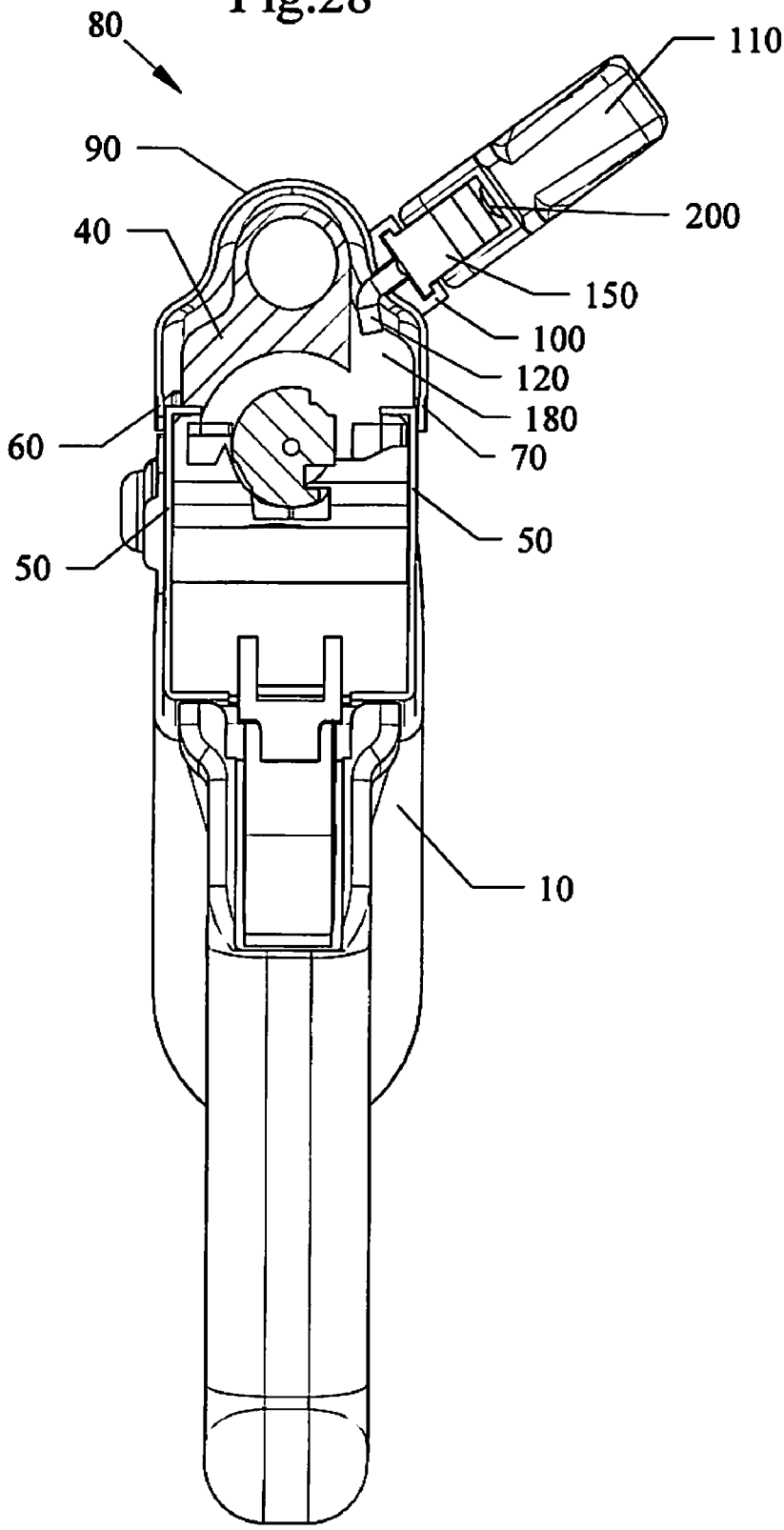
FIG. 28 is a section view showing the modification kit fit to receiver and bolt carrier position relative to the modification kit; and shows the guide track, the slide fit to the guide track, the charging pin and its relationship to the bolt carrier, and the slot in the receiver cover for the movement of the charging pin.

FIG. 28 is a section view showing the modification kit 80 fit to the AK-variant rifle receiver 50 and the bolt carrier 40 position relative to the modification kit 80. FIG. 28 also shows the guide track 100, the slide 150 fit within the guide track 100, the charging pin 120 and its relationship to the bolt carrier 40, and the slot 130 in the modified receiver cover 90 for the movement of the charging pin 120.

Use of the AK modification kit 80 is straightforward. First, blot carrier 40 and receiver cover 90 are substituted for corresponding parts within a firearm in the usual manner. Next, assuming that a right-handed user wishes to easily chamber the firearm, a bullet is driven from the firearm's loaded magazine and into the empty chamber by grasping the firearm's pistol grip with his right hand, pulling auxiliary charging handle 110 to the rear with his left hand, and, then, releasing auxiliary charging handle 110. The firearm's spring-loaded action then returns charging handle 110 to its original, forward position at the front of guide track 100. The handle body 66 can, if desired, be manually pivoted toward the retaining fin for stowage and subsequent use. As auxiliary charging handle 110 is pulled backwardly, engagement charging pin 120 grasps vertical member of catch 180 of bolt carrier 40 and draws bolt carrier 40 rearwardly such that the action of the firearm is caused to chamber a bullet. The entire process of chambering a bullet requires only moments to complete and can be achieved without the right-handed user either taking his eyes away from his intended target or aiming the firearm away from an intended target.

The AK modification kit 80 is intended to accommodate the use of a folding firearm stock and side-mounted optics since the charging handle assembly 110 does not reciprocate with bolt carrier 40 when the firearm is discharged. The kit 80, of course, allows a user to charge the firearm with either the right or left hand.

Although the firearm is referred to as the AK model assault rifle, the invention can be applied to other types of firearms and rifles, and the like.

While kit 10 has been described with a high degree of particularity, it will be appreciated by individuals having experience with firearms that modifications can be made to kit 80. For example, auxiliary charging handle 110 need not be made to pivot, but could be integrally formed with the balance of slide 150. Furthermore, by modifying engagement pin so as to hit the front edge of base block 182, it is possible to eliminate the catch having the vertical and horizontal members. The catch, however, does provide a strong junction between the modification kit receiver cover 90 and bolt carrier 40. Thus, it must be understood that the present invention is not limited merely to kit 80, but rather it encompasses any and all kits within the scope of the following patent claims.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A kit for modifying a firearm having a receiver, a primary charging handle extending outwardly from only one side of the receiver and a bolt carrier in the receiver, said kit comprising:

a modified receiver cover having a crown and a left and right retaining fin integral with a bottom of said crown for engaging the top of the receiver of the firearm, the left retaining fin having an elongated slot extending longitudinally along the left retaining fin on the left side of receiver cover;

one single guide track having one single slot affixed to the left retaining fin aligned with the one single receiver cover slot, said guide track having a pair of retaining flanges being disposed on opposite sides of said slot;

an auxiliary charging handle assembly secured within the guide track, the auxiliary charging handle assembly including a slide being slidably engaged to slide along the length of the guide track, an auxiliary charging handle and an engagement pin projecting inwardly from the slide and extending through said receiver cover slot to engage the bolt carrier positioned within the receiver of the firearm and move the bolt carrier when the auxiliary charging handle is pulled rearwardly; and wherein the bolt carrier of the firearm includes a primary charging handle extending therefrom a direction generally opposite of the auxiliary charging handle and extending outwardly from the receiver cover beneath the retaining fin not having the one single receiver cover slot.

2. The modification kit of claim 1 wherein each of the left and the right the left retaining fins comprise:

an upper and a lower retaining fin, the elongated slot in the left retaining fin being located approximately midway between a top and a bottom of upper portion of the left retaining fin.

3. The modification kit of claim 2 wherein the elongated slot extends from a forward point adjacent the forward most position of travel of a catch surface of the bolt carrier in the firearm receiver to a rearward point adjacent the rearward most position of movement of the front of the catch surface of the bolt carrier.

4. The modification kit of claim 2 wherein the guide track comprises:

an elongated base plate that is attached flush against the upper portion of the left retaining fin, the base plate longitudinal slot dimensioned and positioned to be coextensive with the receiver cover slot.

5. The modification kit of claim 4 wherein the guide track further comprises:

a pair of retaining flanges that extend outwardly from the base plate of the guide track to terminate at free ends remote from retaining fin, the retaining flanges overhanging the guide track base plate along their lengths and defining a pair of opposed grooves for retaining the slide.

6. The modification kit of claim 1 wherein the auxiliary charging handle assembly comprises:

a handle retaining tab as part of a top of the slide;

a foldable auxiliary charging handle pivotally attached to the handle retaining tab by a pivot pin to fold the auxiliary charging handle a stowage position against the modified receiver cover; and a handle retaining tab to limit a range of pivoting motion of the foldable auxiliary charging handle.

7. The modification kit of claim 5 wherein the slide comprises:

an elongated guide body; and a pair of retaining arms affixed to the opposite sides of the elongated guide body that extend outwardly from the guide body to terminate at free ends adjacent to the pair of opposed grooves in the guide track.

8. The modification kit of claim 7 further comprising:

a pair of retaining fingers affixed to the free end of each of the retaining arms, each of the retaining fingers projecting outwardly from a respective one of the retaining arms and into a respective one of the slide track grooves.

9. A method for modifying a firearm having a receiver and a bolt being positioned in the receiver, the method comprising the steps of:

providing a modified receiver cover having a crown and a left and a right retaining fin extending outwardly and downwardly from a bottom of each side of the crown to mate with the receiver of the firearm and an elongated receiver slot extending longitudinally along the left retaining fin of the receiver cover:

attaching a guide track having a longitudinal slot aligned with the receiver slot to the left retaining fin;

providing a slide having an auxiliary charging handle extending outwardly in one direction away from the slide and a charging pin extending outwardly in an opposite direction away from the slide;

slidably securing the slide within the guide track with the charging pin extending through the longitudinal slot into the receiver of the firearm and the auxiliary charging handle extending outwardly from the receiver cover;

removing a receiver cover from the receiver of the firearm; and attaching the modified receiver cover to the receiver of the firearm with the auxiliary charging handle extending outwardly from the left side of the modified receiver cover in a direction opposite of a primary charging handle extending outwardly from a right side of the firearm receiver.

10. The method of claim 9 wherein the step of providing a modified receiver cover comprises the steps of:

forming a U-shaped crown;

attaching the left and a right retaining fins to a left and right leg of the U-shaped crown, each of the left and right retaining fin having an upper portion and a lower portion;

cutting the longitudinal receiver slot approximately midway between the top and bottom of the upper portion of the left retaining fin; and attaching a back wall cover to one end of the U-shaped crown and left and right retaining fins, the back wall cover having a rectangular hole to receive a recoil spring base.

11. The method of claim 9 wherein the step of attaching a guide track comprises the steps of:

forming a guide track having a guide track base plate with a longitudinal slot therein and a pair of retaining flanges that extend outwardly along the length of each side of the base plate and overhanging the guide track base forming opposing grooves approximately parallel with the longitudinal slot; and aligning the guide track longitudinal slot to be coextensive with the receiver slot.

12. The method of claim 11 wherein the step of providing a slide comprises the step of:

forming a slide body with a pair of retaining arms that extend from the guide body to terminate at free ends adjacent to the opposing groves in the slide track for slidable movement; and attaching the charging pin to the slide body with the charging pin extending outwardly through the receiver slot into the receiver of the firearm to contact with the catch surface of the bolt carrier.

13. The method of claim 12 further comprising the steps of:

forming a handle retaining tab as part of a top the slide body extending outwardly from the slide body away from the guide track; and pivotally attaching the auxiliary charging handle to the handle retaining tab with a pivot pin to allow the auxiliary charging handle to fold to a storage position, the auxiliary charging handle abutting the handle retaining tab to limit a range of the pivoting motion.

14. A modified receiver cover system for a firearm having a receiver and a bolt being positioned in the receiver, comprising:

a modified receiver cover having a crown and a left and a right retaining fin extending outwardly and downwardly from a bottom of each side of the crown adaptable to mate with the receiver of the firearm and an elongated receiver slot extending longitudinally along the left retaining fin of the receiver cover;

a guide track having a longitudinal slot aligned with the receiver slot to the left retaining fin; and a slide having an auxiliary charging handle extending outwardly in one direction away from the slide and a charging pin extending outwardly in an opposite direction away from the slide, wherein the slide is adapted to be slidably secured within the guide track with the charging pin extending through the longitudinal slot into the receiver of the firearm and the auxiliary charging handle extending outwardly from the receiver cover, and wherein after removing the receiving cover from the receiver of firearm the modified receiver cover is adapted to be attached to the receiver of the firearm with the auxiliary charging handle extending outwardly from the left side of the modified receiver cover in a direction opposite of a primary charging handle extending outwardly from a right side of the firearm receiver.

15. The modified receiver cover system of claim 14, further comprising:

a U-shaped crown, wherein the left and a right retaining fins are adapted to be attached to a left and right leg of the U-shaped crown;

each of the left and right retaining fin having an upper portion and a lower portion, wherein the longitudinal receiver slot is adapted to be cut approximately midway between the top and bottom of the upper portion of the left retaining fin; and a back wall cover, wherein the back wall cover is adapted to be attached to one end of the U-shaped crown and left and right retaining fins, the back wall cover having a rectangular hole to receive a recoil spring base.

16. The modified receiver cover system of claim 14, wherein the guide track includes:

a guide track base plate with a longitudinal slot therein and a pair of retaining flanges that extend outwardly along the length of each side of the base plate and opposing grooves approximately parallel with the longitudinal slot overhanging the guide track base, wherein the guide track longitudinal slot is adapted to be aligned coextensive with the receiver slot.

17. The modified receiver cover system of claim 16, wherein the slide includes:

a pair of retaining arms that extend from the guide body to terminate at free ends adjacent to the opposing groves in the slide track for slidable movement, wherein the charging pin is adapted to be attached to the slide body with the charging pin extending outwardly through the receiver slot into the receiver of the firearm to contact with the catch surface of the bolt carrier.

18. The modified receiver cover system of claim 17, further comprising:

a handle retaining tab formed as part of a top the slide body extending outwardly from the slide body away from the guide track, wherein the auxiliary charging handle is adapted to be pivotally attached to the handle retaining tab with a pivot pin to allow the auxiliary charging handle to fold to a storage position, the auxiliary charging handle is adapted to abutting the handle retaining tab to limit a range of the pivoting motion.

* * * * *